United States Patent [19]

Kelly

[11] 4,004,629

[45] Jan. 25, 1977

[54] FRAMELESS SLIDING WINDOW ASSEMBLY

[76] Inventor: Donald V. Kelly, 10642 Helendale, Tujunga, Calif. 91042

[22] Filed: Oct. 9, 1974

[21] Appl. No.: 513,296

[52] U.S. Cl. ..... 160/90; 49/413; 49/449

[51] Int. Cl.[2] ..... E06B 3/32; E05D 15/06

[58] Field of Search ..... 160/90, 89, 91; 49/413, 49/449, 485; 16/96

[56] References Cited

UNITED STATES PATENTS

| | | | |
|---|---|---|---|
| 2,761,498 | 9/1956 | Reinhardt | 160/90 |
| 2,869,187 | 1/1959 | Liebman et al. | 160/90 X |
| 2,877,511 | 3/1959 | Viola, Jr. | 16/96 R |
| 3,106,269 | 10/1963 | Revell et al. | 49/413 X |
| 3,315,414 | 4/1967 | Nolan et al. | 160/91 X |
| 3,383,801 | 5/1968 | Dallaire | 49/485 X |
| 3,468,064 | 9/1969 | Fraleigh et al. | 49/413 |
| 3,538,642 | 11/1970 | Fredricksen | 49/449 X |
| 3,808,742 | 5/1974 | Ehret et al. | 49/449 X |
| 3,861,444 | 1/1975 | Portwood | 160/90 |

*Primary Examiner*—Philip C. Kannan
*Attorney, Agent, or Firm*—John E. Wagner

[57] ABSTRACT

A frameless sliding window assembly employing only two shapes for the window casement and with no mullion required. A sliding glass pane is supported to approximately one half its thickness by an elongated plastic key which allows rain and dust to pass to the exterior through weep holes in the casement. A single casement extrusion holds a fixed lite, seals the movable lite and constitutes a screen frame member.

A novel handle is in the form of an extruded shape with a mounting surface, an upstanding handle portion, a catch and an intermediate resilient spring portion.

7 Claims, 13 Drawing Figures

FRAMELESS SLIDING WINDOW ASSEMBLY

BACKGROUND OF THE INVENTION

Horizontal sliding windows have been well accepted in the residential, commercial and mobile home fields for a number of years. They have been favored architecturally, tending to give a long low line to the structure. They do not require complex mechanism for opening and closing as in the case of gear operated casement windows or counter balanced double hung windows. The weight of the moving window or windows is supported totally by the structure and the user need only exert sufficient force to overcome the sliding friction to open or close the window.

Typically, horizontal sliding windows are fashioned generally as horizontal versions of a double hung window having a frame about each pane of glass and a stile portion. Each of these add to the weight and cost of the window and serve to reduce the overall available window space by placing an undesirable interfering mullion at the center of the window or multiple interfering mullions when the window is partially open.

BRIEF STATEMENT OF THE INVENTION

Faced with the foregoing, I have developed a frameless sliding window assembly employing only two simple extruded shapes which define all four sides of the window casement and totally eliminate window frames per se. No mullion is present and a simple novel handle and integral latch secures the window when in closed position. The basic frame serves to secure a half screen. The window system, in accordance with this invention, is self sealing and draining and the sliding pane is supported by and bears against non metallic cushion sealing members only. The pane edge is only partially supported so that dust or debris which might enter the window assembly cannot remain in abrasive contact with the moving pane. The moving pane support member is an elongated, plastic shaped key, locked in the sill member of the casement assembly. A single casement extrusion serves:

a. to secure and seal a fixed lite; and b. seal a movable lite and constitute a screen frame member.

BRIEF DESCRIPTION OF THE DRAWINGS

This invention may be more clearly understood from the following detailed description and by reference to the drawings in which.

DETAILED DESCRIPTION OF THE INVENTION

Figure 1:
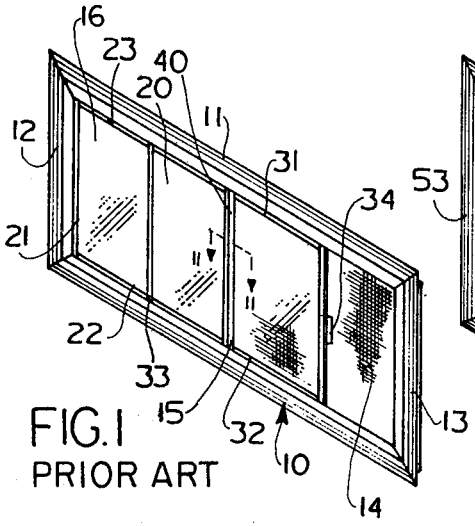
FIG.1 PRIOR ART
FIG. 1 is a perspective view of a horizontal sliding metal frame window in accordance with the prior art.

Now referring to FIG. 1, a typical metal framed window according to the prior art is shown including a metal sill 10, a header 11, jambs 12 and 13 which typically are fabricated from extruded aluminum alloy. Each member, 10–13 includes an edge lip and a casement section which engage the outside wall and framed opening respectively in the structure where installed. Typically, a window of this nature opens at one side and has a half screen 14 with its screen frame 15, one side of which appears in FIG. 1. There is one fixed pane or lite 16 and a movable lite 20. The lite 16 is often separately framed as represented by frame members 21, 22, 23 and 24. The movable lite 20 likewise has four frame members 30, 31, 32 and 33. Various types of closure handles and locks have been devised for such windows. A particularly useful handle and lock is shown in my U.S. Pat. No. 3,813,130, issued May 28, 1974.

In certain cases of the prior art, the fixed lite 16 is secured directly to the frame and therefore the frame members 21 through 23 are not necessarily present. However, the frame members 30, 31, and 33 of the movable window are present.

Figure 2:
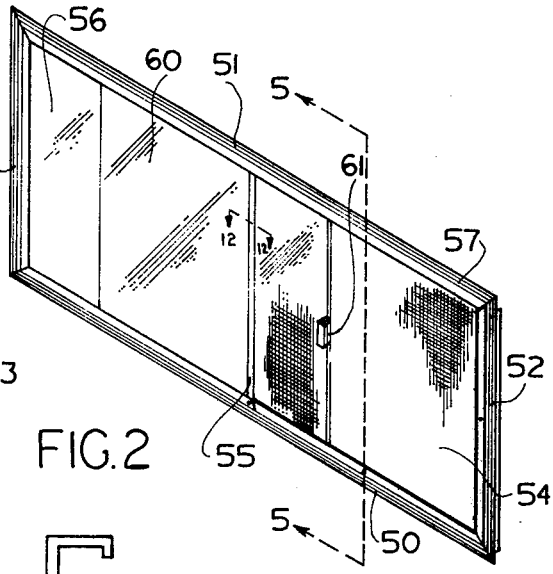
FIG. 2 is a perspective view of a horizontal sliding window in accordance with this invention.
Figure 10:
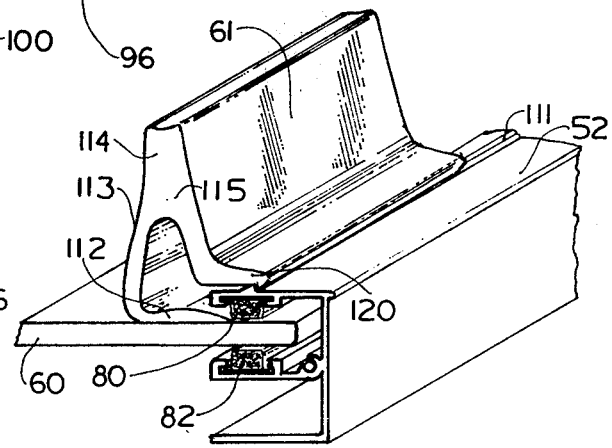
FIG. 10 is a perspective view of the handle locking member of this invention.

In accordance with my invention, I have simplified the design of a simple metal frame window was illustrated in FIG. 2. Again, it employs a sill 50, header 51, jambs 52 and 53 and a half screen 54. The screen 54 is secured in its own frame, one member of which 55 appears in FIG. 2. A fixed lite 56 appears in the drawing of that side of FIG. 2, and a partially opened movable lite 60 appears in FIG. 2. The lite 60 is preferably of tempered or safety glass and has ground edges on all four edges the upper and lower edges to facilitate sliding movement in the frame and to prevent injury to one coming in contact with the window edge. The movable lite 60 has secured to its inner side a novel handle 61 in accordance with this invention which engages the jamb 52 in a manner as best illustrated in FIG. 10. FIGS. 1 and 2 clearly illustrate a principal feature of this invention. You will note by comparison of FIG. 2 with FIG. 1 that in FIG. 2 the relative viewing areas are greater because of the elimination of all frames around the window lites. Particularly noticable is the reduced size of the mullion 40. The increasing of the visible area also has a side effect of reducing the separate number of pieces required in the manufacture of the windows and therefore reducing the cost. The use of tempered glass as compared with conventional glass, of course, does result in increase in cost but this cost, in most installations, is offset by the savings in labor and materials in the design. Also, the window of this design offers a greater safety in the event of a person breaking a window by contact therewith. Of course, tempered glass is designed to shatter upon impact without injury to any person or object.

Figure 3:
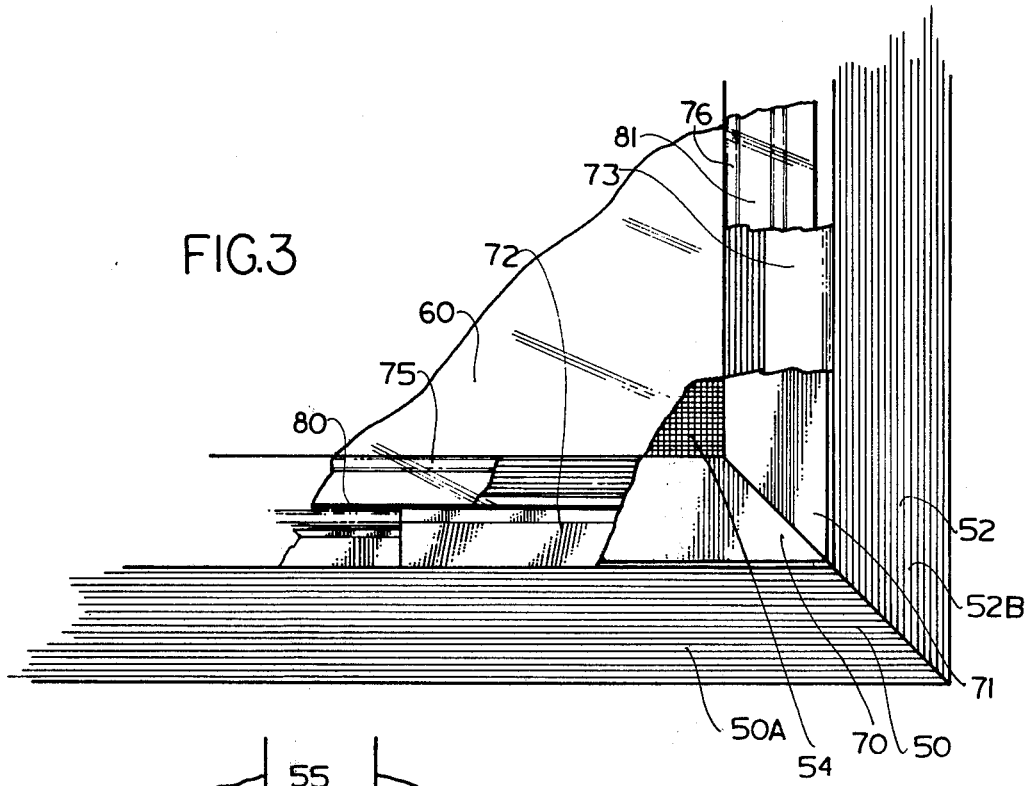
FIG. 3 is an enlarged fragmentary perspective view of the corner of the window in accordance with this invention with portions broken away for clarity.

Another advantage of this invention not apparent in FIG. 2 is that the window assembly is manufactured from only four different extruded shapes including screen frame, adding the plastic guide track and seal disclosed in FIG. 3. The total number of different parts required for a window assembly of applicant's design is significantly less that that of the prior art.

Figure 5:
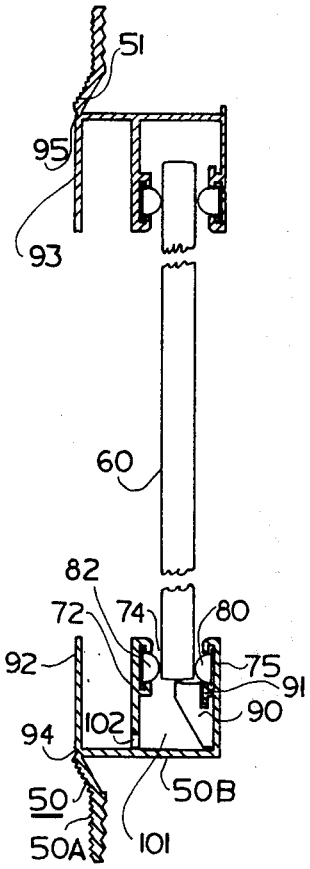
FIG. 5 is a vertical section along line 5—5 of FIG. 2.
Figure 4:
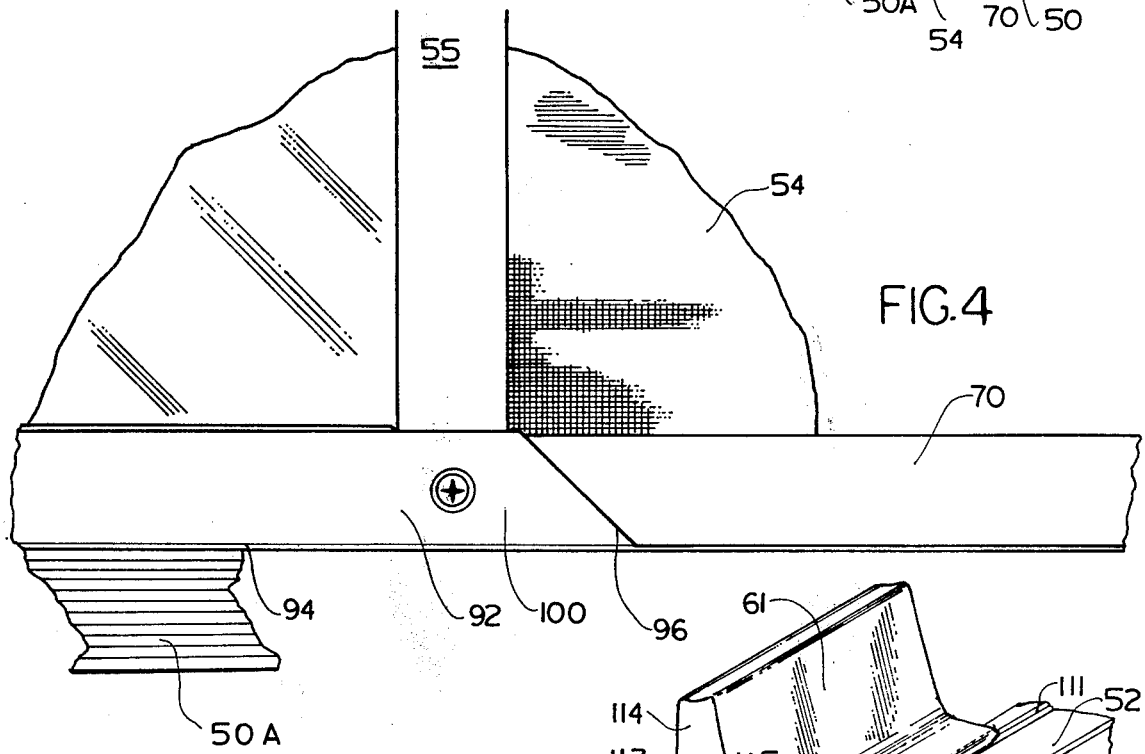
FIG. 4 is an enlarged fragmentary elevational view of the central section of the sill of this invention.

The details of the window assembly and the relative position of parts are best seen from an examination of FIG. 3 in conjunction with FIG. 5 of the drawings. FIG. 3 shows a fragmentary corner of the assembly of FIG. 2 with screen 54 in place while FIG. 5 is a vertical section to the assembly of FIG. 2 with the screen removed. The sill 50 includes a tapered lower flange portion 50A which engages the outer surface of the structure to which the window is attached while the surface 50B, shown in FIG. 5, constitutes the casement portion and rests on the framing of the structure as indicated above. The portion 50A forms a right angle corner with a similar lip 52B of the jamb 52. These two frame members define a corner recess for the screen frame made up of members 70 and 71 and screen proper 54. Note that in this corner which is the lower right hand corner of assembly of FIG. 2, there are no retainers for the screen. As will be seen later, this is unnecessary. The screen members 70 and 71 overlie respective longitudinal external ribs 72 and 73 which define the lower front face and side face of the window groove 74 appearing in FIG. 5. A matching inner or rear rib 75 defines the longitudinal window retaining recess which appears in FIG. 5 as well and through the lite 60 in FIG. 3. It should also be noted in FIG. 3 that a pair of seals 80 and 81 are positioned adjacent to the lite 60 in captive grooves integral with the ribs 75 and 76. Similar seals such as seal 82 appearing in FIG. 5 are held in captive arrangement within the front rib 72. Other seals appear around the periphery of the moving lite 60. It should be noted by reference to FIG. 5 that the header 51 and the sill 50 are identical sections. The only difference between the two which is apparent is that the sill 50 contains a plastic support rib 90 positioned in one corner and captured by a T shaped tang 91 integral with the rear wall 75. The header 51 has the same T shaped tang but no support member 90. One other difference between the sections 50 and 51 is that the front rib 92 of the member 50 is discontinuous as in contrast from its matching member 93 of the header 51. A notch 94 is apparent at the base of the rib 92 and a similar notch 95 appears at the base of rib 93. This notch is instrumental in allowing the selective removal of portions of the rib 92 in a manner which allows the insertion and locking of the screen 54 in place. This feature is apparent in FIG. 4 which shows the front rib 92 which terminates at an angular end 96 with the portion to the right of the angular portion 96 having been removed by severing along the line 96 and breaking the section of the rib 92 at its notch 94. Similarly, as is apparent in FIG. 3, the front rib is absent from the member 52. Given this arrangement, the screen 54, including its frame members 55, 70 and 71 as appearing in FIG. 3, and the upper frame member unshown in the drawing may be inserted and removed by removal of the locking screw 100 appearing in FIG. 4 and by slightly bending the frame of the screen and sliding it to the right and outward in the drawing of FIG. 2. When in place, the screen is held securely by the front rib of the header 51, the section of front rib 92 extending to the right of frame 55 and the screw 100. Of course, additional fastening means may be used if desired but I have found that the arrangement described and shown above more than adequately secures the screen in place. In as much as the total amount of metal in the window assembly has been reduced, I have been able to employ better quality screen frame members, extruded rather than rolled, which actually adds to the overall strength and utility and attractive appearance of the assembly.

One of the most significant features of this invention is apparent in FIG. 5. Here it should be noted that the lite 60 rests on the support 90 and includes virtually line contact with the support member 90 generally along the center line of the lite 60. Support 90, as noted above, is merely a half support, and it extends towards the inner side of the window assembly. If therefore any moisture, dust or debris from the outside passes the seal 82 and enters the cavity 101, it does not interfere with the seal or sliding relationship of the lite 60 on the support 90. Because nearly line contact is achieved between the support 90 and the lite 60, sliding friction is reduced. Any moisture trapped in the recess 101 is relieved by flow through one of a series of openings 102 in the front rib 72 and passes the removed section of rib 92 to the exterior of the structure.

Figure 7:
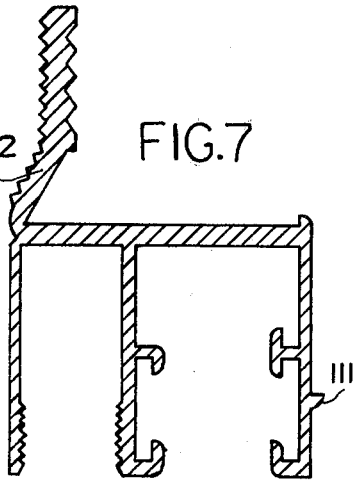
FIG. 7 is an enlarged end view of the jamb section of this invention.
Figure 6:
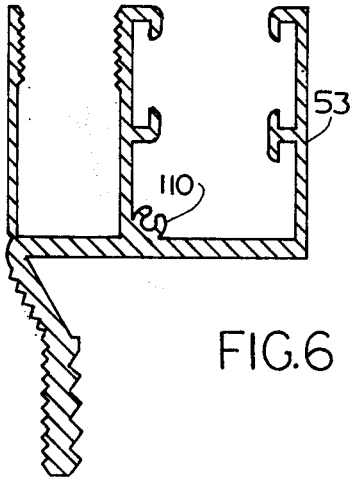
FIG. 6 is an enlarged detail of the sill in accordance with this invention.

Another feature of the invention is apparent by reference to FIGS. 6 and 7 which show the cross section of the jambs 53 and 52 respectively, which may be seen are substantially identical. The only additional features from the extrusions 50 and 51 of FIG. 5 are the screw locking ribs 110 of FIG. 6 and the locking rib 111 of FIG. 7. The screw locking ribs 110 of FIG. 6 are used in a manner that is well known in the extrusion field. These ribs 110 may be eliminated if other forms of corner fastening are employed. The locking rib 111 of FIG. 7 forms an attractive edge detail and may be added to the extrusion form of FIG. 6 and in actuality may be present on all edges. In such case, all window frame extrusions may be identical thereby reducing the cost of windows in accordance with this invention even further.

The presence of edge rib 11 as shown in FIG. 7 forms a significant part of this invention in that it cooperates with the novel handle design as shown in FIG. 10 to secure the window in a closed position to perpetuate a seal and lock the window. This novel arrangement is best seen in FIG. 10. There, the jamb 52 with its integral rib 111 is shown with the lite 60 in a closed position with a foot portion 112 extending between seal 80 and lite 60. The handle 61 appears as a unitary member having a degree of flexibility and having foot portion 112 which is secured to the inner surface of the lite 60 by cement or other means. This foot 112 is connected by a distortable leg portion 113 connected to the main body or hand grip portion 114. This hand grip or body portion includes a second leg 115 terminating in a second foot 116 having a toe or catch 120 positioned to engage the rib 111. The leg 115 and foot 116 are shown of greater thickness than the leg 112 or 113. Given this arrangement, more of the flexibility appears in the leg 113 although this is not necessarily restrictive since both legs 113 and 115 may flex or the major amount of flexibility may be in leg 115. In any event, the foot 112 includes a tapered front surface which rides between the seal 80 and the pane or lite 60 to apply pressure against the lite 60 at its innerface thereby applying a gentle bias force against the lite and in turn against the front of weather seal. The foot 116 rests over the rib 111 in locking arrangement. Locking is effective, being over a distance in the order of 2 to 3 inches and when locked, the window is relatively safe from intrusion by wedging or other similar means to open it. When locked, also the window is relatively well sealed by the pressure applied by the handle. Opening of the window is accomplished simple by grasping the handle of body portion 114 and flexing the handle in the direction of desired movement which disengages the toe 120 and allows the window to slide freely. All of this is achieved in a single unitary member.

Figure 9:
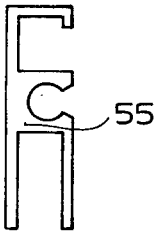
FIG. 9 is a section of the screen frame of this invention.
Figure 8:
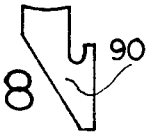
FIG. 8 is an end view of the pane support member of the assembly.

The preferred cross sectional shapes of the support 90 and the screen frame 55 appear in FIGS. 8 and 9 respectively. These shapes are not mandatory but the relative size and location of the support member 90 constitutes a principal element of this invention.

Figures 11, 12, 12A:
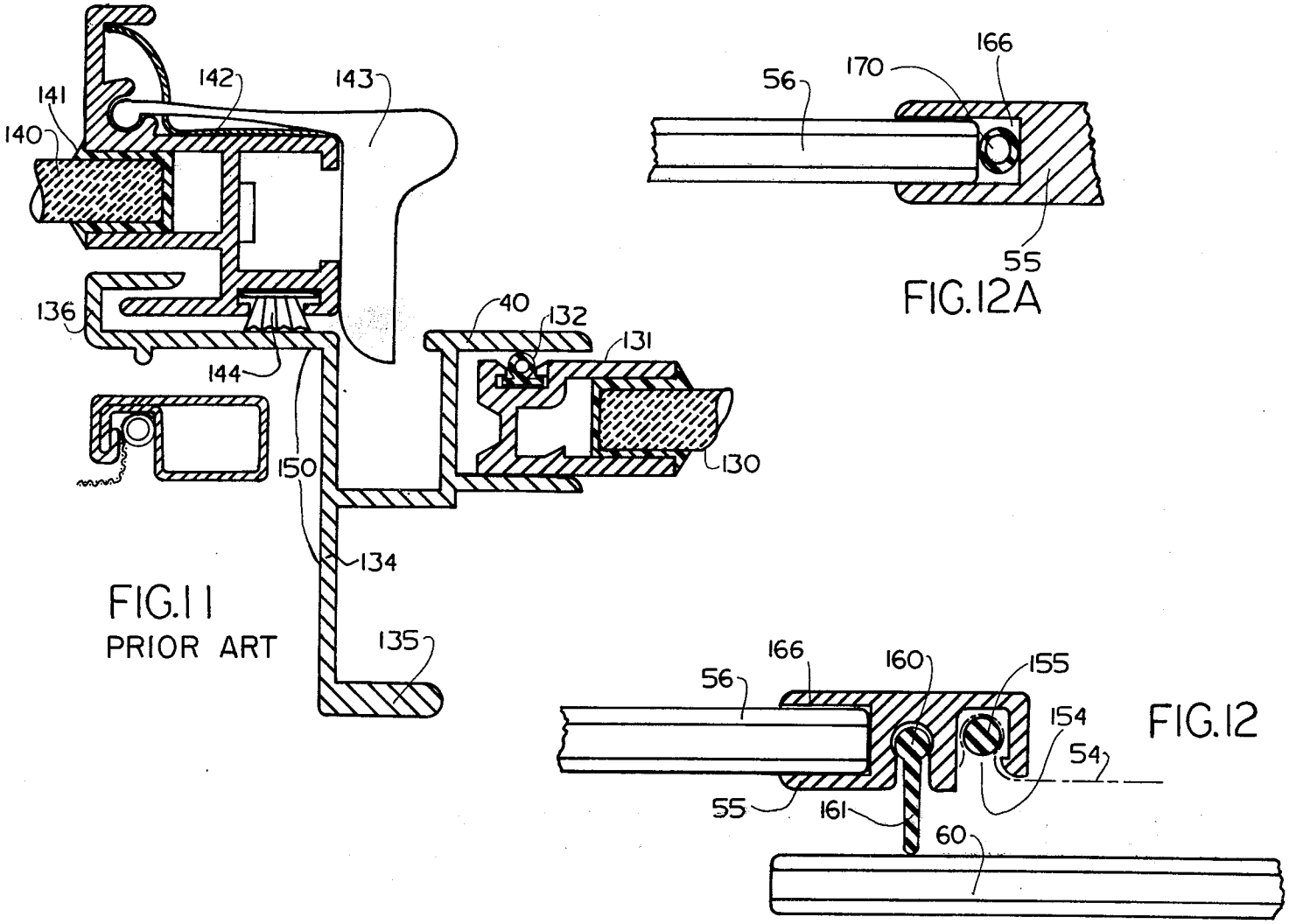
FIG. 11 PRIOR ART
FIG. 11 is a vertical section along line 11—11 of FIG. 1.
FIGS. 12 and 12*a* are fragmentary vertical sections of alternate forms taken along line 12—12 of FIG. 2.

Another feature of this invention is clearly visible by comparison of FIGS. 11 and 12 of the drawings. FIG. 11 shows the cross section through the mullion 40 of FIG. 1 while FIG. 12 shows a cross section through the screen frame member 55 which substitutes for the mullion 40 in this invention as illustrated in FIG. 2.

FIG. 11 shows a fixed lite 130 within its frame 131 with a seal 132 positioned within a recess in mullion 40. The mullion 40 is a complex extruded shape including a pair of outward extending stiffening ribs 134 and 135, and a reentrant portion 136 providing a seal groove. The movable lite 140 positioned within a gasket 141 in its frame 142 carries a release handle catch 143 and a seal 144. Although there are variations in the design of the center mullion 40 and the frames 131 and 142, basically they involve the complexity here shown. FIG. 11 shows only the recess 150 defined by the corner in the mullion for holding the screen. Screen fastening means, of course, are required.

Now referring to FIG. 12, the simplicity of the design of applicant's invention is clearly apparent. Of course, there is no real mullion present, only the screen frame 55, which forms the multiple functions of securing the ends of screen 54 in a groove 154 by a flexible bead 155. This arrangement for securing screening is, of course, well known. The number 55 also includes a keyhole groove 160 with a wiper type seal 161 longitudinally secured therein to engage the movable lite 60. The fixed lite 56 is in slip fit relationship with the channel groove 166 of the part 55. I have found that using a slip fit, no seal is required to prevent intrusion of moisture through the interior. In certain circumstances, however, it may be desirable to employ a seal, and in such case, I have illustrated in FIG. 12*a* a suitable seal in the form of a hollow thin walled tube 170 which is compressibly compressed between the lite 56 and the bottom wall of the groove 166. The frame 55 also stiffens the lite 56, holds the head and sill at proper spacing and through seal 161 helps to prevent rattling of the movable lite 60.

It is therefore apparent that the number 55 provides three totally different functions in supporting the screen 54, the seal 161 and the lite 56. This single member substitutes for the complex mullion and as is described above, the two frame members for the respective lites is unnecessary.

A further advantage of this invention is also apparent in comparison of FIGS. 11 and 12 in that the handle shown in applicant's FIG. 10 also serves as a lock and is located at the edge of the window and not in the center mullion area. This is in comparison with the lock 143 of FIG. 11.

The above described embodiments of this invention are merely descriptive of its principles and are not to be considered limiting. The scope of this invention instead shall be determined from the scope of the following claims and including their equivalents.

What is claimed is:

1. A window assembly comprising a window frame including as members thereof a pair of jambs, a header and a sill;

at least two of said members including portions defining a track for movement of a window lite to affect the opening and closing of the window assembly;

a window lite positioned in the track of said frame;

the sill portion including a longitudinally extending member in said track in elongated supporting contact with the edge of siad lite and a recess below and lite;

handle means engaging said lite for movement within said frame;

seal means supported by said frame and extending along the surfaces of said frame portions in a sealing relationship with said lite;

said supporting member extending only partially across the thickness of said track leaving said recess unobstructed on the outer or weather side of said lites except for said seal means whereby foreign material including moisture contacting said lite and passing said seal means can drop below said lite into said recess;

said sill portion further defining drainage openings therein communicating between said recess and the exterior of the assembly;

wherein said handle means includes a portion extending into engagement with one of said track defining portions of said assembly when said window is in a closed position whereby said lite is mechanically biased against said seal means of said assembly;

wherein said handle includes a wedge-shaped foot portion extending generally parallel to the inner surface of said lite whereby said foot portion extends between said lite and frame when said lite is closed thereby mechanically wedging said lite against said seal means.

2. A sashless window assembly comprising a window frame including as members thereof a pair of jambs. a header and a sill;

at least two of said members including portions defining a track for movement of a sashless window lite to affect the opening and closing of the window assembly;

a sashless lite positioned in the track of said frame;

the sill portion including a longitudinally extending member in said track in elongated supporting contact with the edge of said sashless lite and a recess below said lite;

handle means engaging said lite for movement within said frame;

seal means supported by said frame and extending along the surfaces of said frame portions in a sealing relationship with said lite;

said supporting member extending only partially across the thickness of said track leaving said recess unobstructed on the outer or weather sid e of said lite except for said seal means whereby foreign material including moisture contacting said lite and passing said seal means can drop below said lite into said recess; and said sill portion further defining drainage openings therein communicating between said recess and the exterior of the assembly.

3. The combination in accordance with claim 1 wherein said handle means includes a first portion extending into locking engagement with one of said track defining portions of said assembly and a second portion extending in wedging engagement between said lite and said track defining portions of said assembly when said window is in a closed position whereby said lite is mechanically biased against said seal means of said assembly.

4. The combination in accordance with claim 1 wherein said frame assembly includes a rib extending generally parallel to said track defining portions and dividing the opening in said assembly into two descrete portions;

said rib defining a recess for securing an edge of a screen and a second recess for positioning a second sashless lite therein;

said screen positioned in end to end relationship with said second sashless lite.

5. A window assembly comprising a window frame including a pair of jambs, a header, and a sill;

said frame members each including a pair of inwardly extending ribs defining a track for movement of a window lite to affect the opening and closing of the window assembly;

a first sashless window lite positioned in the track of said frame;

a second pair of inwardly extending ribs defining a track for a second window lite;

a movable second sashless window lite positioned in the groove defined by said second pair of inwardly extending ribs;

said second and first window lites including edges which engage the fixed frame of said window assembly;

a vertically extending member of said frame positioned generally along the vertical center line of the window;

said vertically extending member including a groove having dimensions to produce sealing contact with the edge of said first lite and providing edge support therefore;

said vertically extending member including a groove and outwardly extending seal means extending toward said second sashless window lite;

said vertically extending member including means for securing the edge of screen wire therein extending in the general parallel direction with said lites;

screen wire secured to said vertically extending member and to said frame for covering a portion of the opening defined by said frame;

said second window lite being movable to open or close the region covered by said screen wire;

said vertically extending member in direct supporting contact with said screen wire outwardly extending seal means and said first sashless window lite.

6. The combination in accordance with claim 5 wherein said vertically extending member defines an additional groove for receiving said screen whereby said one lite and screen are both supported and secured by at least in part said vertically extending member.

7. The combination in accordance with claim 6 wherein said vertically extending member is positioned in the said groove in said frame whereby said window lite and screen are in generally edge to edge relationship in the plane of said groove.

* * * * *